US011906203B2

(12) United States Patent
Hazzard et al.

(10) Patent No.: US 11,906,203 B2
(45) Date of Patent: Feb. 20, 2024

(54) WATER HEATER CONTROL SYSTEM WITH POWERED ANODE ROD

(71) Applicant: Ademco Inc., Golden Valley, MN (US)

(72) Inventors: Frederick Hazzard, Plymouth, MN (US); Gregory Young, Blaine, MN (US); Adam Myre, Minnetonka, MN (US)

(73) Assignee: Ademco Inc., Golden Valley, MN (US)

( * ) Notice: Subject to any disclaimer, the term of this patent is extended or adjusted under 35 U.S.C. 154(b) by 501 days.

(21) Appl. No.: 17/002,609

(22) Filed: Aug. 25, 2020

(65) Prior Publication Data

US 2021/0095891 A1 Apr. 1, 2021

Related U.S. Application Data

(60) Provisional application No. 62/907,222, filed on Sep. 27, 2019.

(51) Int. Cl.

| | |
|---|---|
| ***F24H 9/20*** | (2022.01) |
| ***F24H 1/18*** | (2022.01) |
| ***F24H 1/20*** | (2022.01) |
| ***F24H 9/45*** | (2022.01) |
| *F24H 1/00* | (2022.01) |

(52) U.S. Cl.

CPC ..... *F24H 9/2021* (2013.01); *F24H 1/185* (2013.01); *F24H 1/20* (2013.01); *F24H 9/45* (2022.01); *F24H 1/0018* (2013.01); *F24H 2250/10* (2013.01)

(58) Field of Classification Search

None

See application file for complete search history.

(56) References Cited

U.S. PATENT DOCUMENTS

| | | | | |
|---|---|---|---|---|
| 2,606,271 A * | 8/1952 | Morris | F24H 9/2021 | 392/455 |
| 3,134,008 A * | 5/1964 | Finn | H05B 3/06 | 392/455 |
| 3,172,993 A * | 3/1965 | Finn | H05B 3/82 | 392/455 |

(Continued)

OTHER PUBLICATIONS

Baxter et al., "Offshore Cathodic Protection 101: What it is and how it works," Deepwater Corrosion Services Inc., 2013, retrieved Aug. 25, 2020 from https://www.cathodicprotection101.com/, 4 pp.

(Continued)

*Primary Examiner* — Thor S Campbell

(74) *Attorney, Agent, or Firm* — Greenberg Traurig, LLP; Ryan D. Sharp; David J. Dykeman

(57) ABSTRACT

A water heater control system comprising a temperature sensor, an anode rod, and a controller. The controller is configured to receive a signal indicative of a temperature from the temperature sensor and apply a voltage and/or current to the anode rod. A mounting bracket mates with a spud of a water heater and provides a conduit space for conductors providing connectivity among the controller, temperature sensor, and anode rod. The mounting bracket may provide mechanical support for the anode rod and the temperature sensor. The mounting bracket may comprise a housing mechanically supporting and surrounding the controller.

18 Claims, 7 Drawing Sheets

(56) References Cited

U.S. PATENT DOCUMENTS 3,187,161 A * 6/1965 Finn ..... H05B 3/82 392/455
3,845,661 A * 11/1974 Hollweck ..... G01K 1/146 392/441
3,867,274 A * 2/1975 Herman ..... C23F 13/02 204/196.19
4,093,529 A * 6/1978 Strobach ..... C23F 13/00 204/196.18
4,136,001 A * 1/1979 Nozaki ..... C23F 13/02 204/196.08
4,255,647 A * 3/1981 Rickert ..... C23F 13/02 204/196.03
4,279,705 A * 7/1981 Riggs, Jr. ..... C25B 1/00 205/49
4,397,726 A * 8/1983 Schwert ..... C23F 13/02 204/196.18
4,434,039 A * 2/1984 Baboian ..... F24H 9/45 204/290.14
4,773,977 A * 9/1988 Houle ..... F24H 9/2007 204/196.17
4,786,383 A * 11/1988 Houle ..... C23F 13/18 205/733
4,808,794 A * 2/1989 Foreman ..... H05B 3/82 392/455
4,830,724 A * 5/1989 Houle ..... C23F 13/02 204/288.5
4,954,233 A * 9/1990 Houle ..... C23F 13/18 204/196.16
4,972,066 A * 11/1990 Houle ..... F24H 9/45 204/196.05
4,975,560 A * 12/1990 Wardy ..... F24H 9/45 204/196.05
5,023,928 A * 6/1991 Houle ..... F24H 9/45 204/196.04
5,109,474 A * 4/1992 Cameron ..... F24H 9/45 392/455
5,159,659 A * 10/1992 Cameron ..... H05B 3/82 392/455
5,176,807 A * 1/1993 Kumar ..... C23F 13/18 204/290.13
5,335,311 A * 8/1994 Groothuizen ..... H05B 3/82 338/315
5,949,960 A * 9/1999 Hall ..... F24H 9/2021 392/455
7,017,251 B1 * 3/2006 Murphy ..... F24H 9/45 204/196.24
8,068,727 B2 11/2011 Phillips et al.
8,106,337 B2 * 1/2012 Steenekamp ..... F24H 1/202 219/442
8,515,268 B2 * 8/2013 Anliker ..... H05B 3/82 99/275
2008/0190919 A1 * 8/2008 Kahite ..... C23F 13/18 220/4.12
2012/0031751 A1 * 2/2012 Moghbeli ..... C23F 13/20 204/196.01
2012/0037512 A1 * 2/2012 Robertson ..... C02F 1/46109 204/290.01
2013/0089310 A1 * 4/2013 Wielstra ..... H05B 1/0269 392/457
2014/0262825 A1 * 9/2014 Al-Mahrous ..... C23F 13/10 204/196.37
2014/0277816 A1 * 9/2014 Branecky ..... F24H 1/202 700/300
2014/0321838 A1 * 10/2014 Farris ..... F24H 9/2021 392/441
2015/0329981 A1 * 11/2015 Wijenberg ..... C25D 9/08 428/626
2018/0128514 A1 5/2018 Knoeppel et al.
2019/0195534 A1 * 6/2019 Chaudhry ..... F24H 9/45
2020/0248319 A1 * 8/2020 Al-Mahrous ..... C23F 13/16
2021/0189570 A1 * 6/2021 Al-Khaldi ..... C23F 13/06
2022/0136114 A1 * 5/2022 Huck ..... B08B 3/12 204/196.37
2022/0260282 A1 * 8/2022 Kernich ..... G05D 23/1927

OTHER PUBLICATIONS

YouTube, "Introduction to Cathodic Protection," MATCORmedia, retrieved from https://www.youtube.com/watch?v=i2ZZEQUI05w, uploaded by matcor.com on Apr. 26, 2013, 1 pp.

Apcom, "Product Preservers, Powered Anode System," APCPP18003 Specification Sheet, 2018, 1 pp. (Applicant points out, in accordance with MPEP 609.04(a), that the year of publication, 2018, is sufficiently earlier than the effective U.S. filing date, so that the particular month of publication is not in issue.).

Apcom, "Product Preservers, Powered Anode System, Permanently Eliminate Aluminum Hydryoxide and Most Smelly Water and Help Extend the Life of Your Water Heater Tank" APCPP18002 Literature Brochure, 2018, 2 pp. (Applicant points out, in accordance with MPEP 609.04(a), that the year of publication, 2018, is sufficiently earlier than the effective U.S. filing date, so that the particular month of publication is not in issue.).

* cited by examiner

WATER HEATER CONTROL SYSTEM WITH POWERED ANODE ROD

This application claims the benefit of U.S. Provisional Patent Application Ser. No. 62/907,222, filed Sep. 27, 2019, and entitled, "WATER HEATER CONTROL SYSTEM WITH POWERED ANODE ROD," which is incorporated by reference herein in its entirety.

TECHNICAL FIELD

The disclosure relates to water heating systems.

BACKGROUND

Tank-type water heating systems may utilize heat generating components such as gas burners or electrical heating elements in order to heat water within a water tank. A temperature sensor in thermal communication with the water in the water tank provides an indication of the temperature of the water in the tank. The heat generating components may be activated to heat the water within the water tank based on the temperature measured by the temperature sensor. A powered anode rod may be immersed in the water tank to reduce corrosion of the water tank and/or mitigate flocculant formation.

SUMMARY

In one example, the disclosure is directed to a water heater control system comprising a temperature sensor, an anode rod, and a controller. The controller is configured to receive a signal indicative of a temperature from the temperature sensor, and configured to apply a voltage, current, or voltage and current to the anode rod. The water heater system may further comprise a mounting bracket configured to mate with a particular opening of a water heater, such as a spud. The spud defines an access from an interior of a water tank of the water heater to an exterior of the water heater.

In some examples, an anode lead electrically connects the anode rod and the controller, and a sensor lead electrically connects the temperature sensor and the controller. The anode lead and the sensor lead may extend at least partially through the mounting bracket. The mounting bracket may mechanically support the anode rod and the temperature sensor. The mounting bracket may comprise a conduit space and the anode lead and the sensor lead may extend at least partially into the conduit space. When the mounting bracket is engaged with the spud of the water heater, the mounting bracket may provide a water-tight seal around a perimeter of the mounting bracket and between a body of water in the water tank and the conduit space. In examples, the mounting bracket mechanically supports a housing (e.g., either singly or in combination with other components mechanically supporting the housing). The mounting bracket may comprise a housing. The housing may mechanically support the controller. In some examples, the housing may surround the controller such that the controller is within an interior of the housing.

In another example, the disclosure is directed to a water heating system comprising a tank configured to hold water and a heating apparatus configured to heat water in the tank. A temperature sensor extends into the interior of the tank and is configured to detect a temperature of the water in the tank. An anode extends into the interior of the tank and is coupled to a power source. The power source may be configured to apply an electrical current to the anode.

The water heating system may further comprise a controller configured to control, based on a detected temperature of the water in the tank, the heating apparatus to heat the water in the tank to a selected temperature, and control the power source to apply a selected electrical current to the anode to at least one of reduce corrosion of the wall of the tank or reduce flocculant formation.

In another example, the disclosure is directed to a technique for controlling a water heater using a water heater control system. The technique includes receiving, by a controller, a signal indicative of a temperature from a temperature sensor, wherein the temperature comprises the temperature of water in a tank of a water heater. The technique additionally includes applying, by the controller, a voltage, a current, or a voltage and a current to an anode in the tank of the water heater. The water heater control system comprises the temperature sensor, the anode, and the controller, with the controller configured to receive the signal indicative of the temperature from the temperature sensor and apply the voltage, the current, or the voltage and the current to the anode. The water heater control system further comprises a mounting bracket, wherein the mounting bracket is mated with a spud of the tank of the water heater. An anode lead electrically connects the anode and the controller, with the anode lead extending at least partially through the mounting bracket. A sensor lead electrically connects the temperature sensor and the controller, with the sensor lead extending at least partially through the mounting bracket.

The details of one or more examples are set forth in the accompanying drawings and the description below. Other features, objects, and advantages will be apparent from the description and drawings, and from the claims.

DETAILED DESCRIPTION

Figure 1:
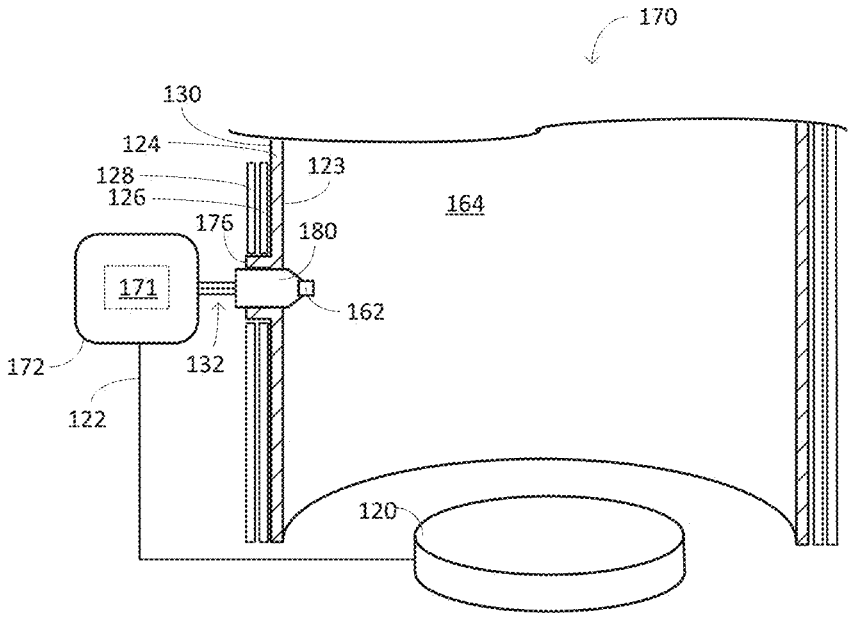
FIG. 1 is a diagram illustrating an example of a water heating system having a controller and a mounting bracket.

In some examples, a water heater control system disclosed herein includes a controller in electrical connectivity with a temperature sensor and an anode rod which both access a water tank of the water heater through a single water heater spud or other single opening in the water tank. The water heater control system configuration may reduce a number of required accesses into a water tank, and may provide a reduction in the physical footprint of the water heater control system. The relative proximity among the temperature sensor, anode rod, and controller afforded may allow the controller to be mechanically supported and surrounded by a single housing box. The compact arrangement may aid in replaceability and manufacturability. Additionally, water heater control system may be configured for effective operation in water heaters of varying volume and geometry using the programmable controller.

As described herein, in some examples, the water heater control system comprises a controller in electrical connection with a temperature sensor and also in electrical connection with an anode rod. The temperature sensor and the anode rod may be mechanically supported by a mounting bracket positioned in an opening (e.g., a spud) in the tank of a water heater. The controller may be electrically connected to the temperature sensor via a sensor lead which extends at least partially into the mounting bracket. The controller may be electrically connected to the anode rod via an anode lead which extends at least partially into the mounting bracket.

The mounting bracket may be configured to form a water-tight seal when engaged with a spud or other opening in the tank of a water heater. The spud provides an access from an exterior of the tank of the water heater to the interior of the tank of the water heater. The mounting bracket may comprise a mating surface configured to mate with the spud of the water heater and form the water-right seal. The mating surface may partially surround a conduit space within the interior of the mounting bracket. The sensor lead between the controller and the temperature sensor and the anode lead between the controller and the anode rod may extend at least partially through the conduit space.

The mounting bracket may be configured to mechanically support the temperature sensor and the anode rod such that the temperature sensor and the anode rod extend into a water heater tank through a single opening, such as a water heater spud. The mounting bracket may mechanically support the temperature sensor such that the temperature sensor is in thermal communication with a volume of water in the water tank when the mounting bracket forms the water-tight seal with the water heater spud. The mounting bracket may mechanically support the anode rod such that the anode rod is in fluid communication with the volume of water in the water tank of the water heater when the mounting bracket forms the water-tight seal with the water heater spud. The mounting bracket may mechanically support the temperature sensor and the anode rod with fittings that form a water-tight barrier between the body of water in the water tank of the water heater and a conduit space within the mounting bracket. The conduit space may accommodate the sensor lead between the controller and the temperature sensor and the anode lead between the controller and the anode rod.

The controller may receive a signal indicative of a temperature from the temperature signal and, based on the indicative signal, cause a heating apparatus in thermal communication with the water tank of the water heater to generate thermal energy. The controller may be configured to receive electrical power from a power supply and be configured to distribute electrical power to various components such as relays, switches, servo valves, solenoids, or other devices. The controller may provide a voltage, a current, or a voltage and a current to the anode rod and prompt a current from the anode rod to a vessel wall of the water tank to provide anti-corrosion protection. In examples, the controller is configured to substantially maintain a voltage difference between the anode and the vessel wall when the power source applies the voltage, the current, or the voltage and the current to the anode.

The mounting bracket may comprise a portion of a housing. The housing may mechanically support the controller. The housing may surround the controller such that the controller is within the interior of the housing. The water heater control system may further comprise one or more gas valves. The one or more gas valves may comprise a pilot gas valve configured to deliver fuel to a pilot burner and/or a main gas valve configured to deliver fuel to a main burner. The housing may mechanically support the one or more gas valves. The housing may surround the one or more gas valves such that the one or more gas valves are within the interior of the housing.

FIG. 1 is a diagram illustrating a portion an example water heating system 170. Water heating system 170 comprises water tank 164 configured to hold a volume of water within the interior of tank 164. Water heating system 170 also includes heating apparatus 120. Heating apparatus 120 is configured to establish thermal communication with a body of water held by water tank 164. Heating apparatus 120 may be configured to generate heat using electrical power (e.g., resistive heat), gas combustion, some combination of electrical power and gas combustion, a heat pump, or some other methods whereby heat is generated. Heating apparatus 120 is situated within water heating system 170 such that at least some portion of the heat generated by heating apparatus 120 is thermally communicated to water tank 164, in order to increase or maintain the temperature of a body of water within water tank 164. Heating apparatus 120 may be immersed within water tank 164 (e.g., an electrical immersion heater) or may thermally communicate with water tank 164 using some other configuration, such as a flue or some other heat exchange component providing a heat exchange surface with water tank 164.

Water tank 164 comprises vessel wall 124 having inner vessel surface 123 and outer vessel surface 130. Inner vessel surface 123 of vessel wall 124 is configured to have some portion of its surface area in contact with a volume of water held by water tank 164. An outer shell 128 of water heating system 170 may at least partially surround outer vessel surface 130 of vessel wall 124. Various components may be present between outer shell 128 and outer vessel surface 124, such as insulating layer 126.

Water heating system 170 further comprises spud 176. Spud 176 defines an opening through vessel wall 124 extending from outer vessel surface 130 to inner vessel surface 123. The spud 176 may be threaded or unthreaded, and may have any surface configuration around the opening defined by spud 176. Spud 176 may be unitary with vessel wall 124, or may be an insert fitted within a pre-existing opening through vessel wall 124. Spud 176 is configured such that fluid communication may occur from outer vessel surface 130 to inner vessel surface 123 through the opening defined by spud 176.

Water heating system 170 may include a mounting bracket 180. At least some portion of mounting bracket 180 is configured to be inserted into spud 176. Mounting bracket 180 may be configured to mate with spud 176 and form a water-tight seal between inner vessel surface 123 and outer vessel surface 130. Mounting bracket 180 and spud 176 may be configured to form a threaded connection, an interference fit, a spring loaded connection, and/or any other arrangement whereby mounting bracket 180 and spud 176 mate to form a water-tight seal between inner vessel surface 123 and outer vessel surface 130. Mounting bracket 180 may mechanically support instrumentation 162. Instrumentation 162 may include one or more instruments configured to be in physical contact with or otherwise in physical communication (e.g.

thermal communication) with the volume of water held in water tank 164. Instrumentation 162 may include, for example, a temperature sensing unit, an anode rod, or other instrumentation. Mounting bracket 180 may be configured to provide a conduit space which accommodates electrical leads establishing electrical communication with one or more instruments comprising instruments 162, such as electrical leads 132. The conduit space may be configured within mounting bracket 180 such that when mounting bracket 180 is mated and forms a water-tight seal with spud 176, the conduit space allows electrical leads 132 to extend from instruments 162 to a location outside outer vessel wall 130 while maintaining the water-tight seal with spud 176. For example, the conduit space may be an internal channel extending at least partially through mounting bracket 180 and configured to allow access for electrical leads originating at some location outside outer vessel surface 130 and extending to instrumentation 162.

A housing 172 mechanically supports a controller 171. In examples, housing 172 surrounds controller 171. As described below, controller 171 may include one or more processors with processing circuitry configured to perform the control techniques described herein. Controller 171 may be in electrical communication with instrumentation 162 through leads 132. Controller 171 may be configured to direct operation of components controlling the heat production of heating apparatus 120. For example, when heating apparatus 120 is an electrical heater, controller 171 may be configured to direct operation of relays, switches, or other devices which connect heating apparatus 120 to a main power source. When heating apparatus 120 is configured to provide heat by combustion, controller 171 may be configured to direct operation of pilot and/or main fuel valve, as well as other components necessary to initiate a combustion. Controller 171 may be configured to direct operation of components in order to provide energy inputs to heating apparatus 120 via pathways 122. Pathways 122 may comprise, for example, main power electrical conduits to heating apparatus 120, main and/or pilot fuel lines to heating apparatus 122, or a combination of electrical and fuel lines.

Figure 2:
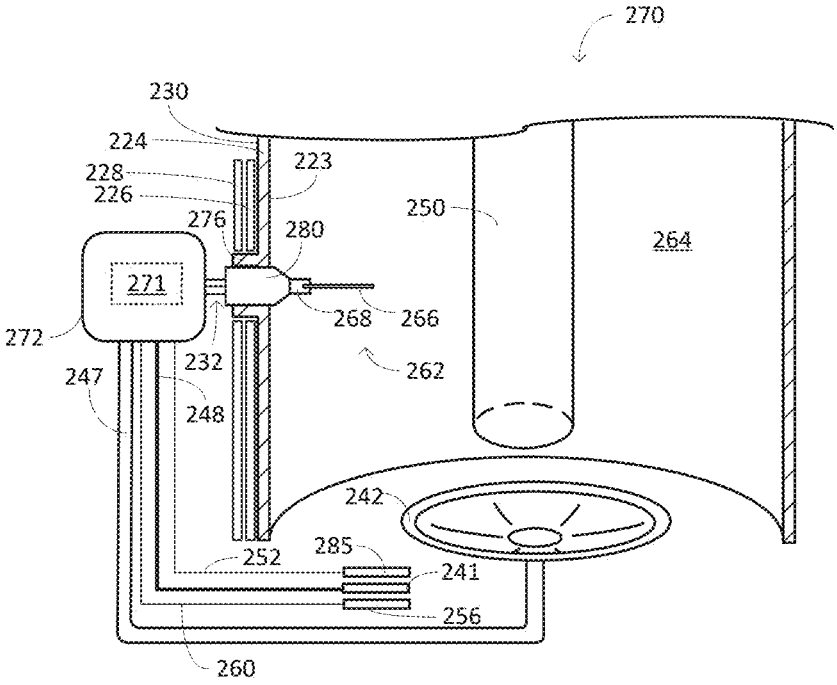
FIG. 2 is a diagram illustrating an example of a water heating system having a mounting bracket mechanically supporting one or more instruments.

For example, FIG. 2 is a schematic diagram illustrating a water heating system 270 configured to generate heat through the combustion of a fuel. Water heating system 270 comprises pilot burner 241 and main burner 242. Main fuel line 246 is in fluid communication with and provides main fuel flow to a main burner 242. A flue 250 may be an exhaust for main burner 242. Pilot fuel line 248 is in fluid communication with and provides pilot fuel flow to pilot burner 241. A pilot fuel valve (not shown) may control pilot fuel through pilot fuel line 248, and a main fuel valve (not shown) may control main fuel flow through main fuel line 247. A controller 271 may direct the operations of the pilot fuel valve and the main fuel valve.

In some examples, system 270 includes a thermoelectric device 285 such as a thermopile and/or thermocouple connected by an electrical line 252 to controller 271, and a pilot spark ignitor 256 for igniting a pilot gas flow discharging from pilot burner 241. Pilot spark ignitor 256 may be connected via electrical line 260 to controller 271. Thermoelectric device 285 may be in thermal communication with pilot flame generated at pilot burner 241, and may convert some portion of a heat flux emitted by the pilot flame into electrical energy. Water heating system 270 may be a continuous pilot system such that pilot burner 241 produces a pilot flame substantially continuously, or may an intermittent pilot system wherein the pilot flame is originated in response to a call for heat generated or recognized by controller 272. The pilot flame established at pilot burner 241 may be configured to be in thermal communication with a main fuel flow discharging through main burner 242 in order to initiate combustion at main burner 242.

Controller 271 may be configured to direct operation of the components controlling heat production within water heating system 270. For example, controller 270 may be configured to directly or indirectly control pilot spark ignitor 256, the pilot fuel valve, and the main fuel valve. Controller 271 may be in electrical and/or data communication with a temperature sensor configured to be in thermal communication with a body of water held by water tank 264. For example, instrumentation 262 may include temperature sensor 268, and controller 271 be in electrical and/or data communication with the temperature sensor via electrical leads 232. Controller 271 may be configured to initiate heat generation utilizing at least pilot spark ignitor 256, the pilot fuel valve, and the main fuel valve in response to a signal provided by temperature sensor 268. In this manner, controller 271 may be configured to direct operation of components controlling the heat production of water heater system 270. Controller 271 may be configured to ensure a pilot flame at pilot burner 241 is established prior to initiating main fuel flow to main burner 242, in order to avoid situations leading to discharges of uncombusted main fuel into surrounding environments.

Instrumentation 262 of water heating system 270 may include an anode rod 266 with at least some portion of anode rod 266 configured to be in fluid communication with a volume of water held by water tank 264. Controller 271 may be in electrical and/or data communication with anode rod 266 via electrical leads 232. Water heating system 270 may comprise water tank 264, vessel wall 224, inner vessel surface 223, outer vessel surface 230, outer shell 228, insulating layer 226, spud 276, mounting bracket 280, instrumentation 262, electrical leads 232, housing 272, and controller 271, which may be configured to operate similarly to and in relation to other components of water heating system 270 in the same manner as that discussed for the water tank, vessel wall, inner vessel surface, outer vessel surface, outer shell, insulating layer, spud, mounting bracket, instrumentation, electrical leads, housing, and controller respectively of water heating system 170.

Figure 3:
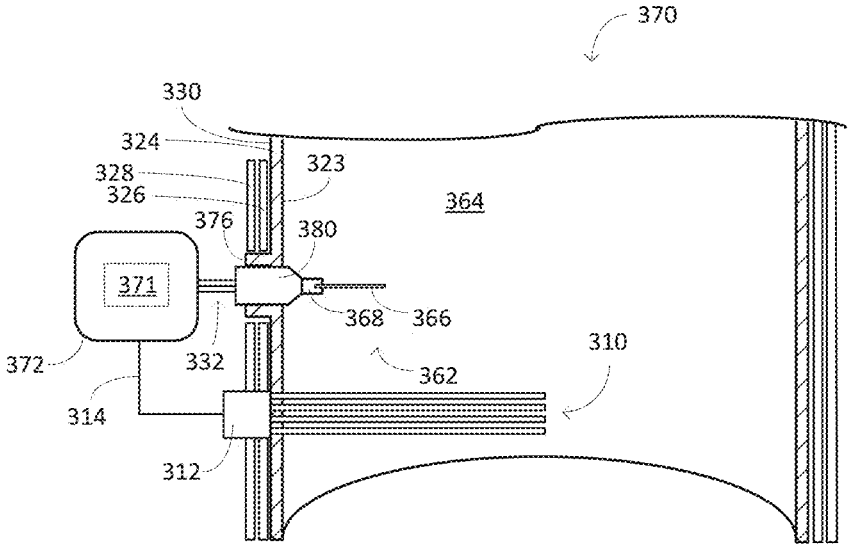
FIG. 3 is a diagram illustrating an example of a water heating system having a controller and a mounting bracket.

As discussed, controller 171 may be configured to direct operation of components providing energy inputs when a heating apparatus 120 (FIG. 1) is configured to generate heat using electrical power (e.g. resistive heat). For example, FIG. 3 is a diagram illustrating a water heating system 370 configured to generate heat through the use of electrical heaters 310. Electric heaters 310 may be immersed within water tank 364 (e.g., electrical immersion heaters) and/or may thermally communicate with water tank 364 using some other heat exchange component providing a heat exchange surface with water tank 364. Electrical heaters 310 may be electrically connected to a control box 312. Control box 312 may include digital and/or analog components such as relays, switches, and other devices configured to provide main electrical power to heaters 310 for the generation of heat.

Controller 371 may be configured to direct operation of components within control box 312 or elsewhere in water heating system 370 which function to allow main electrical power to electrical heaters 110. Controller 371 may be in electrical and/or data communication with a temperature sensor configured to be in thermal communication with a body of water held by water tank 364. For example, instrumentation 362 may include temperature sensor 368, and controller 371 be in electrical and/or data communication with the temperature sensor via electrical leads 332. Controller 371 may be configured to initiate heat generation by directing components within control box 312 or elsewhere in water heating system 370 to provide electrical power to one or more of electrical heaters 310. Controller 371 (and/or components within control box 312 or elsewhere in water heating system 370) may be configured to provide additional functions, such as a sequence of heater operation within electrical heaters 310 based on a temperature signal, over temperature shutoffs based on a temperature signal, recognition of individual burned out heating elements within electrical heaters 310, and other functions.

Instrumentation 362 of water heating system 370 may include an anode rod 366 with at least some portion of anode rod 366 configured to be in fluid communication with a body of water held by water tank 364. Controller 371 be in electrical and/or data communication with anode rod 366 via electrical leads 332. Water heating system 370 may comprise water tank 364, vessel wall 324, inner vessel surface 323, outer vessel surface 330, outer shell 328, insulating layer 326, spud 376, mounting bracket 380, instrumentation 362, electrical leads 332, housing 372, and controller 371, which may be configured to operate similarly to and in relation to other components of water heating system 370 in the same manner as that discussed for the water tank, vessel wall, inner vessel surface, outer vessel surface, outer shell, insulating layer, spud, mounting bracket, instrumentation, electrical leads, housing, and controller respectively of water heating systems 170 and 270.

In some examples, anode rod 366 may be a unitary component with one or more electrical heaters, such as one or more of electrical heaters 310. The unitary component may be configured and constructed to provide powered anode functions and electrical heater functions, and configured to establish electrical connectivity with a controller such as controller 371 through one or more electrical leads. The one or more electrical leads may comprise an anode lead configured to establish electrical connectivity between the anode and the controller. The unitary probe may be a single rigid body mechanically supported by mounting bracket 380, and configured to be in thermal and fluid contact with a volume of water in water tank 364.

Water heating system 170 may comprise a heat pump water heater, with heating apparatus 120 comprising a heat pump. The heat pump may utilize a working fluid (e.g., a refrigerant) to transfer heat from a heat source external to water tank 164 (such as a surrounding environment of water heating system 170) to a heat sink in thermal communication with water tank 164. The heat pump may comprise a condenser, an expansion valve, an evaporator, and/or a compressor. A condenser coil may be in thermal communication with water tank 164 to provide heat to a volume of water held by water tank 164. Controller 171 may be configured to direct operation of components controlling the heat production of the heat pump. For example, controller 171 may be configured to direct operation of relays, switches, or other devices which control the heat generation and other functions of the heat pump comprising the heat pump water heater. Controller 171 may be configured to direct operation of the heat pump via pathways 122.

Heating apparatus 120 is configured to establish thermal communication with a body of water held by water tank 164. Heating apparatus 120 may be configured to generate heat using electrical power (e.g. Resistive heat), gas combustion, some combination of electrical power and gas combustion, or some other methods whereby heat is generated.

Figure 4:
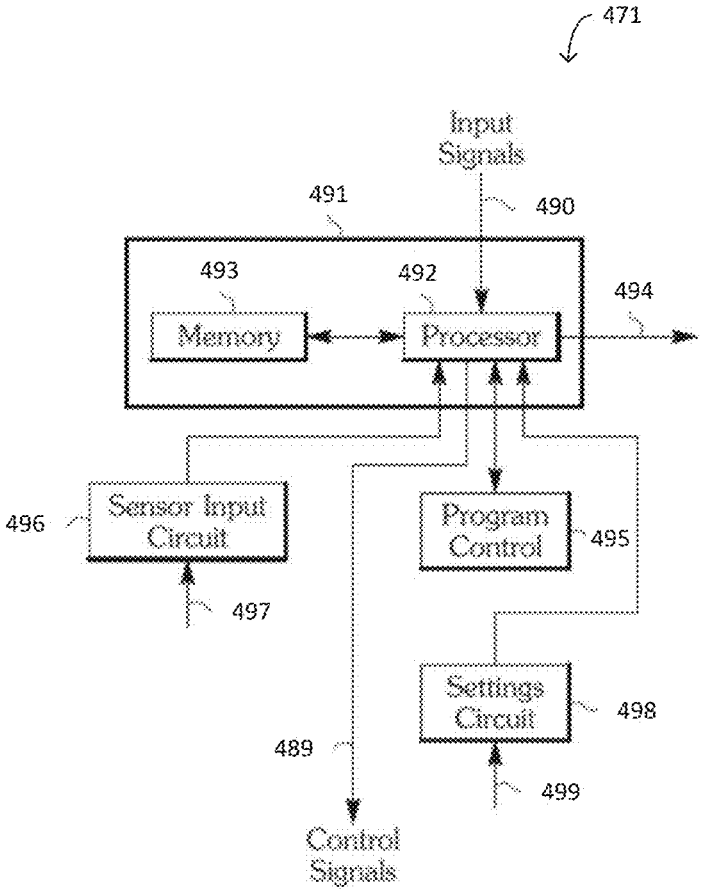
FIG. 4 is a schematic diagram illustrating an example of a controller of a water heating system.

FIG. 4 is a diagram illustrating an example controller 471. Controller 471 may be, for example, controller 171 (FIG. 1), controller 271 (FIG. 2), and/or controller 371 (FIG. 3). Input signals 490 may go to a processing block 491 which may incorporate a processor 492 and memory 493 that are connected to each other. Processor 492 may include processing circuitry one or more digital signal processors (DSP), general purpose microcontrollers, application-specific integrated circuits (ASIC), field-programmable gate arrays (FPGA), or other equivalent integrated or discrete logic circuitry A connection line 497 may connect one or more instruments to a sensor input circuit 497. For example, connection line 497 may connect one or more instruments comprising instrumentation 162 (FIG. 1), instrumentation 262 (FIG. 2), and/or instrumentation 362 (FIG. 3). Processor 492 may receive sensor signals from sensor input circuit 497. Settings 499, such as those of temperature and time, and the like, may go to settings circuit 498 and then on to processor 492. Output control signals may be transmitted from processor 492 via communication line 494 to one or more actuators and/or components. For example, output control signals may be transmitted from processor 492 via communication line 494 to direct operation of components controlling the heat production of heating apparatus 120 FIG. 1), to directly or indirectly control pilot spark ignitor 256, a pilot fuel valve, and a main fuel valve (FIG. 2), and/or to direct components within control box 312 or elsewhere in water heating system 370 to provide electrical power to one or more of electrical heaters 310 (FIG. 3). Output control signals may be transmitted from processor 492 via communication line 494 to direct operation of one or more instruments comprising instrumentation 162 (FIG. 1), instrumentation 262 (FIG. 2), and/or instrumentation 362 (FIG. 3), such as anode rod components 266 (FIG. 2) and/or anode rod 366. Indicator signals may be transmitted from processor 492 via communication line 494 to various instruments such as displays, gauges, indicator lights, sound emanating devices, and the like. Temperature and other setpoints may be entered along communication line 499 to settings circuit 499. From settings circuit 499, setting signals may go to processor 492. Entries from inputs may be from thermostats, keyboards, tunable knobs, switches, and so forth.

Figure 5:
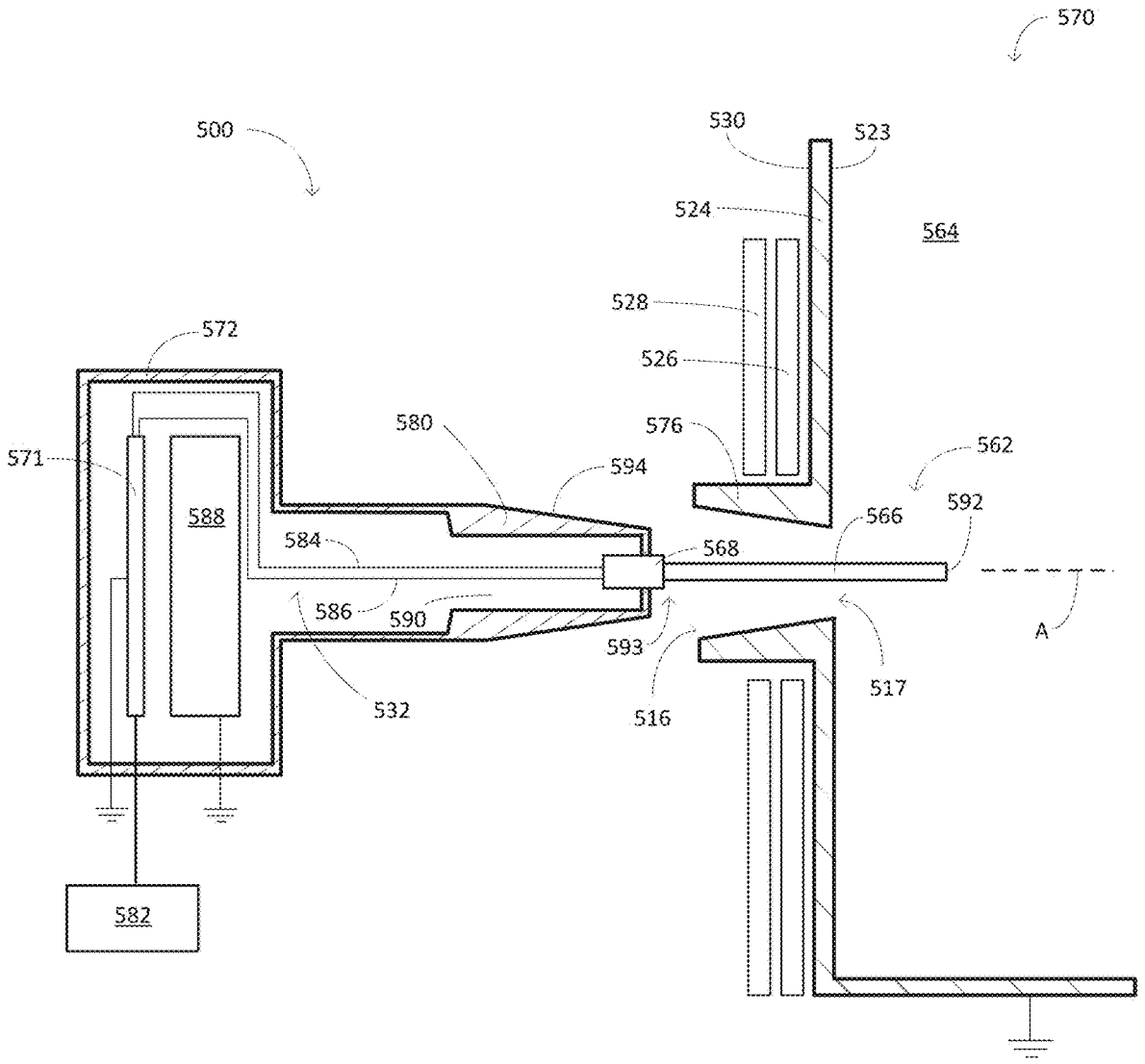
FIG. 5 is a diagram illustrating an example of a water heater controller comprising a housing and a mounting bracket.

FIG. 5 is a diagram illustrating a water heater control system 500. Water heater system 500 provides a control system comprising controller 571, temperature sensor 568, and anode rod 566, and is configured such that temperature sensor 568 and anode rod 566 may access water tank 564 using a single opening, represented as spud 576. Mounting bracket 580 may mechanically support temperature sensor 568 and anode rod 566 in a manner whereby temperature sensor 568 and anode rod 566 extend into an interior of water tank 564 when mounting bracket 580 mates with and forms a water-tight seal with spud 576. Sensor lead 586 may electrically connect temperature sensor 568 and controller 571, and anode lead 584 may electrically connect anode rod 566 and controller 571. Mounting bracket 580, when mated with spud 576, may provide a water-tight seal between a volume of water within water tank 564 and controller 571, sensor lead 586, and anode lead 584. A housing 572 may mechanically support controller 571. In examples, housing 572 may surround controller 571 such that controller 571 resides within an interior of housing 571. Housing 571 may comprise some portion of mounting bracket 580. Water heater control system 500 may configure temperature sensor 568, anode rod 566, mounting bracket 580, controller 571, and housing 572 in a manner which reduces the number of required accesses into water tank 564, and may be configured to provide a reduced physical footprint.

As discussed, water heater control system 500 comprises controller 571. Controller 571 may be, for example, controller 171 (FIG. 1), controller 271 (FIG. 2), controller 371 (FIG. 3) and/or controller 471 (FIG. 4). In examples, controller 571 comprises one or more microprocessors. Controller 571 may be configured to direct operation of components controlling the heat production of a heating apparatus configured to be in thermal communication with a water tank of a water heater. For example, controller 571 may be configured to direct operation of relays, switches, or other devices which connect one or more electrical heaters to a main power source. Controller 571 may be configured to direct operation of pilot and/or main fuel valves, as well as other components necessary to initiate a combustion. Controller 571 may be configured to receive sensor signals from a sensor configured to provide indication of a physical parameter, such as temperature. Controller 571 may be configured to receive setting inputs, such as those of temperature and time. Controller 571 may be configured to communicate output control signals to digital components, analog components, or digital components and analog components. Controller 571 may receive electrical power from a power supply 582. Controller 571 may be configured to distribute electrical power received from power supply 582 to components which control the heat production of a water heater, such as relays, switches, or other devices.

Water heater control system 500 comprises a temperature sensor 568. Temperature sensor 568 may be, for example, temperature sensor 268 (FIG. 2), temperature sensor 368 (FIG. 3), and/or may comprise instrumentation 162 (FIG. 1). Temperature sensor 568 is configured to sense a temperature and provide a signal indicative of the temperature sensed. Temperature sensor 568 may be an electrical device which produces a voltage based on the temperature sensed. For example, temperature sensor 568 may comprise a thermocouple having a hot junction and a cold junction. Temperature sensor 568 may comprise a thermopile. Controller 571 may receive a signal indicative of a temperature from temperature sensor 568 via sensor lead 586. Sensor lead 586 may comprise, for example, electrical leads 132 (FIG. 1), electrical leads 232 (FIG. 2), and/or electrical leads 332 (FIG. 3). Controller 571 may be configured to receive the signal indicative of the temperature from temperature sensor 568 and recognize a requirement for heat generation based on the indicative signal. In examples, temperature sensor 568 may be configured to provide an analog signal indicative of a temperature to an analog-to-digital (A/D) converter (not shown), and the A/D converter may provide a digital signal to controller 571.

Water heater control system 500 additionally comprises anode rod 566. Anode rod 566 may be, for example, anode rod 266 (FIG. 2), anode rod 366 (FIG. 3), and/or may comprise instrumentation 162 (FIG. 1). Anode rod 566 may comprises an electrically conductive material. In examples, anode rod 566 comprises at least one of titanium and/or a stainless steel. Anode rod 566 may be an elongate body comprising a first end 593 and a second end 592. The first end 593 of anode rod 566 ("anode first end 593") may be configured to receive a current, a voltage, or a voltage and a current. The anode first end 593 may be configured to establish electrical communication with a conductor (e.g., anode lead 584). For example, the anode first end 593 may be mechanically coupled to the conductor, with the mechanical coupling configured to provide an electrical path between the conductor and anode first end 593. The second end 592 of anode rod 566 ("anode second end 592") may be a free end configured to extend into a water tank and establish fluid communication with a body of water held by a water tank.

Controller 571 may be configured to provide a voltage, current, and/or a voltage and current to anode 566 via anode lead 584. Anode lead 584 may comprise, for example, electrical leads 132 (FIG. 1), electrical leads 232 (FIG. 2), and/or electrical leads 332 (FIG. 3). Controller 571 may be configured to vary the voltage, current, and/or a voltage and current provided to anode 566. Controller 571 may be configured to utilize an electronic device to provide the voltage, current, and/or a voltage and current provided to anode 566. The electronic device may be, for example, a circuit comprising a Pulse Width Modulator (PWM) controlling a Field Effect Transistor (FET), with controller 571 configured to determine a switching rate and/or pulse period of the PWM. The FET may be in series with anode 566 and the PWM may be configured to cause the FET to rapidly open and close, to provide an average voltage and average current to anode 566 determined by, for example, a ratio of the FET on-time to a pulse period determined by the PWM.

In examples, temperature sensor 568 and anode rod 566 may be a unitary probe. The unitary probe may be configured and constructed to provide temperature sensing functions and powered anode functions, and configured to establish electrical connectivity with controller 571 through one or more electrical conductors, such as sensor lead 586 and/or anode lead 584. The unitary probe may be a single rigid body mechanically supported by mounting bracket 580, and configured to be in thermal and fluid contact with a volume of water in water tank 564 when mounting bracket 580 mates with spud 576.

Water heater control system 500 additionally comprises mounting bracket 580. Mounting bracket 580 may be, for example, mounting bracket 180 (FIG. 1), mounting bracket 280 (FIG. 2), and/or mounting bracket 380 (FIG. 3). At least some portion of mounting bracket 580 is configured to insert into a spud of a water heater, such as, spud 576. Mounting bracket 580 may be configured to mate with the spud and form a water-tight seal around the external perimeter of mounting bracket 580. Mounting bracket 580 may be configured to form a threaded connection, an interference fit, a spring loaded connection, and/or some other fitting arrangement whereby mounting bracket 580 may mate with a water heater spud to form a water-tight seal around the external perimeter of mounting bracket 580. In examples, mounting bracket 580 may be configured to mechanically support at least temperature sensor 568 and anode rod 566. Sensor lead 586 and anode lead 586 may extend at least partially through mounting bracket 580.

Mounting bracket 580 may comprise a mating surface 594 surrounding a conduit space 590. Conduit space 590 may house sensor lead 586 and anode lead 584. Mounting bracket 580 may be configured to mechanically support temperature sensor 568 and anode rod 592 with one or more mechanical fittings, where the one or more mechanical fittings provide a water-tight barrier between a body of water and conduit space 590 when the body of water contacts some portion of anode rod 566, some portion of temperature sensor 568, or some portion of both anode rod 566 and temperature sensor 568. The water-tight barrier may serve to isolate the body of water contacting anode rod 566 and/or temperature sensor 568 from sensor lead 586 and anode lead 584.

FIG. 5 also illustrates water heating components 570, comprising a spud 576 into which mounting bracket 580 may be configured to insert. Water heating system 570 includes a water tank 564 configured to hold a volume of water. Water tank 564 comprises vessel wall 524 having inner vessel surface 523 and outer vessel surface 524. Inner vessel surface 523 of vessel wall 524 is configured to have some portion of its surface area in contact with a volume of water held by water tank 564. An outer shell 528 of water heating system 570 may at least partially surround outer vessel surface 530 of vessel wall 524. Various components may be present between outer shell 528 and outer vessel surface 524, such as insulating layer 526.

Spud 576 comprises an opening from outer vessel surface 530 to inner vessel surface 523, and extends through vessel wall 524. Spud 576 may comprise a first opening 516 on outer vessel surface 530 and a second opening 517 on vessel inner surface 523, with first opening 516 in fluid communication with second opening 517. A longitudinal axis A may extend through spud 576 and intersect first opening 516 and second opening 517. Spud 576 may define one or more cross-sectional areas perpendicular to longitudinal axis A through which fluid communication between first opening 516 and second opening 517 is established. The one or more cross-sectional areas may have any shape at any location along longitudinal axis A between outer vessel surface 530 and inner vessel surface 523. For example, spud 576 may define a substantially circular cross-sectional area at one or more points along longitudinal axis A between outer vessel surface 530 and inner vessel surface 523. The one or more cross-sectional areas may be substantially uniform between outer vessel surface 530 and inner vessel surface 523. For example, spud 576 may define a substantially uniform cylindrical path where fluid communication between first opening 516 and second opening 517 may occur. The one or more cross-sectional areas may be substantially non-uniform between outer vessel surface 530 and inner vessel surface 523. For example, spud 576 may define a substantially frustroconical path where fluid communication between first opening 516 and second opening 517 may occur. Mounting bracket 580 and mating surface 594 may have any configuration necessary for mounting bracket 580 to mate with spud 576 and form a water-tight seal around the external perimeter of mounting bracket 580.

Water heater control system 500 may comprise a housing 572. Housing 572 may mechanically support controller 571. Housing 572 may comprise mounting bracket 580. In examples, housing 572 may surround controller 571. In some examples, water heater control system 500 comprises a gas valve 588. Controller 571 may be configured to control gas valve 588 based on a signal indicative of a temperature received from temperature sensor 568. Gas valve 588 may be a pilot fuel valve, a main fuel valve, or an integrated valve block comprising both a pilot fuel valve and a main fuel valve. Housing 571 may surround the pilot fuel valve, the main fuel valve, or both the pilot fuel valve and main fuel valve.

As illustrated, water heating components 570 may comprise water tank 564, vessel wall 524, inner vessel surface 523, outer vessel surface 530, outer shell 528, insulating layer 526, and spud 576. Water heater control system 500 may comprise mounting bracket 580, instrumentation 562 (comprising temperature sensor 568 and anode rod 566), electrical leads 532 (comprising anode lead 584 and sensor lead 586), housing 572, and controller 571. These components may be configured to operate similarly to and in relation to other components of water heating components 570 and water heater control system 500 in the same manner as that discussed for the water tank, vessel wall, inner vessel surface, outer vessel surface, outer shell, insulating layer, spud, mounting bracket, instrumentation, electrical leads, housing, and controller respectively of water heating systems 170, 270, and 370.

Figure 6:
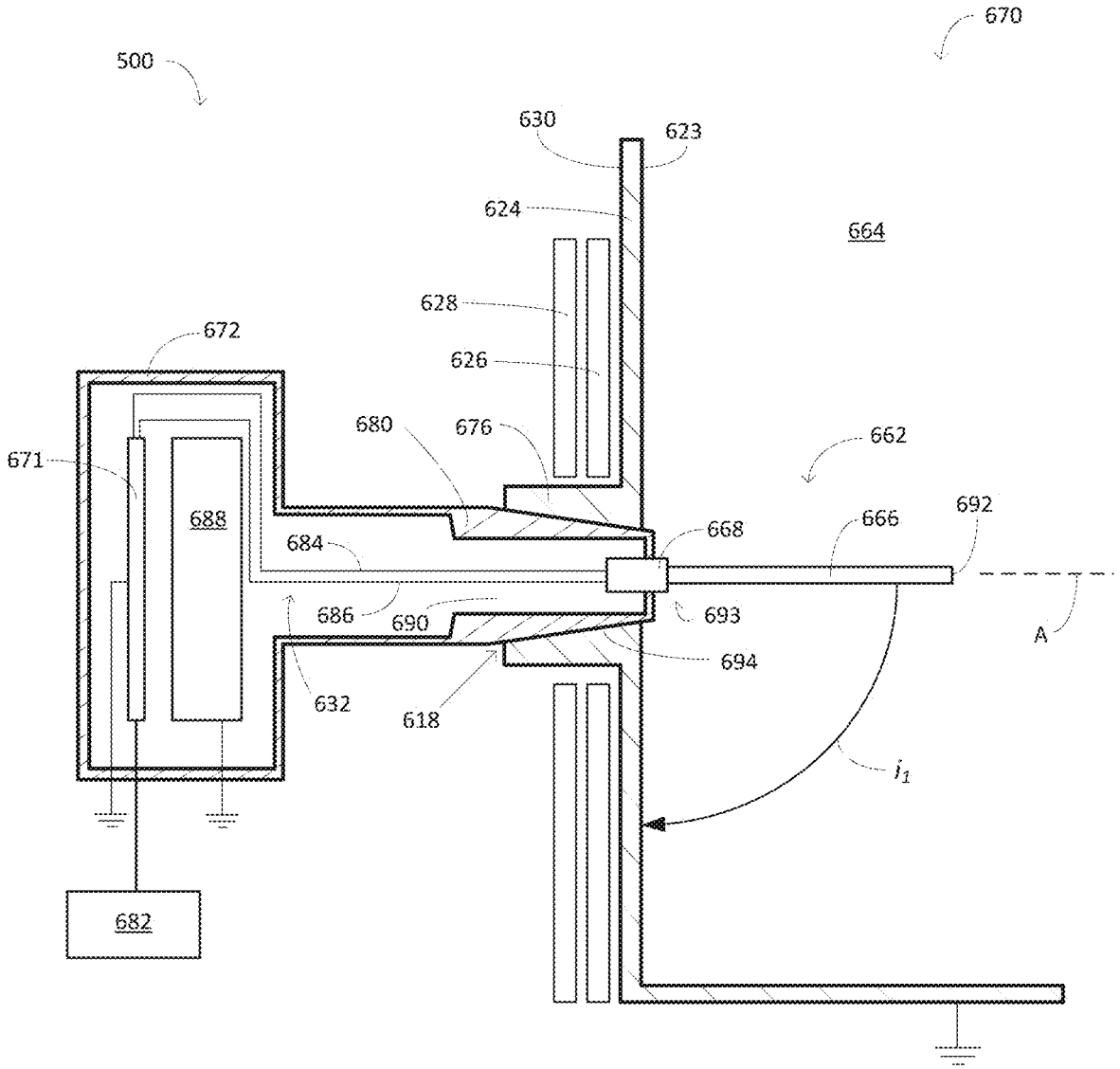
FIG. 6 is a diagram illustrating an example of a water heater controller mated with a spud of water heater.

As discussed, mounting bracket 580 may be configured to mate with a water heater spud such as spud 576 and form a water-tight seal around some portion of the external perimeter of mounting bracket 580. For example, FIG. 6 is a diagram illustrating water heater control system 600. Water heater control system 600 comprises mounting bracket 680 mated with spud 676 of water heating components 670. Mounting bracket 680 is mated with spud 676 and may act singly or with other components to form a water-tight seal at least around external perimeter 618 of mounting bracket 680. For example, mounting bracket 680 may be configured to mate with spud 676 and provide the water-tight seal in conjunction with a material inserted between mounting bracket 680 and spud 676. The mating established between mounting bracket 680 and spud 676 may act to compress the inserted material when mounting bracket 680 is mated with spud 676.

For example, mating surface 694 of mounting bracket 680 may comprise external threads configured to threadably engage a set of internal threads comprising spud 676. The threadable engagement may act singly to provide a water-tight seal at least around external perimeter 618, or may act to compress, for example, a thread sealing material such as a tape between the external and internal threads, in order to provide the water-tight seal. Mating surface 694 may be configured to substantially conform to an interior surface of spud 676 when mounting bracket 680 is inserted into spud 676. Mating surface 694 may be configured such that the conformance generates frictional engagement between outer surface 694 and the internal surface of spud 676 over an area partially or fully surrounding the longitudinal axis A. The conformance may act singly to provide a water-tight seal at least around external perimeter 618, or may act to compress, for example, an adhesive, gasket material, or other thread sealing material between outer surface 694 of mounting bracket 680 and the internal surface of spud 676, in order to form the water-tight seal. Mounting bracket 680 may comprise an external flange having a bearing face substantially parallel to and surrounding longitudinal axis A, with the external flange configured to compress a sealing material as mounting bracket 680 is mated with spud 676.

Mounting bracket 680 may provide a conduit space 690 similar to conduit space 590 (FIG. 5). Conduit space 690 may be configured to accommodate sensor lead 686 and anode lead 684. Conduit space 690 may be configured within mounting bracket 680 such that when mounting bracket 680 is mated and forms a water-tight seal with spud 676, conduit space 690 allows sensor lead 686 and anode lead 686 to extend from temperature sensor 668 and anode rod 666 respectively to a location outside of water tank 664, while mounting bracket 680 maintains the water-tight seal with spud 676. For example, conduit space 690 may be configured to allow sensor lead 686 and anode lead 686 to extend from temperature sensor 668 and anode rod 666 respectively to the location of a controller 671, located outside of water tank 664.

Mounting bracket 680 may be configured to mechanically support temperature sensor 668 and anode rod 692 with one or more mechanical fittings in the same manner as that described for the mechanical support of temperature sensor 568 and anode rod 592 by mounting bracket 580 (FIG. 5). The one or more mechanical fittings provide a water-tight barrier between a body of water held by water tank 664 and conduit space 690 when mounting bracket 680 mechanically supports temperature sensor 668 and anode rod 692, and the body of water within water tank 664 contacts anode rod 666 and/or temperature sensor 668. The water-tight barrier may serve to isolate the body of water within water tank 664 from sensor lead 686 and anode lead 684.

As illustrated by FIG. 6, mounting bracket 680 may be configured to support anode rod 666 such that anode first end 693 establishes electrical communication with anode lead 686 while anode second end 692 extends into water tank 664. Anode lead 686 may establish electrical connectivity between anode first end 693 and controller 671, allowing controller 671 to provide a voltage, current, and/or a voltage and current to anode 666. For example, controller 671 may directly provide a DC voltage, current, and/or a voltage and current to anode lead 684 and anode first end 693, or controller 671 may provide an AC voltage to a rectifier in electrical communication with anode lead 684 and anode first end 693. Anode 666 may thereby serve as the powered anode in an impressed current cathodic protection system (ICCP).

The voltage, current, and/or a voltage and current to anode 666 may cause polarization of vessel wall 624 of water tank 664 when water tank 664 holds a body of water and anode 664 is in fluid communication with the body of water. Polarization of vessel wall 624 may be caused by electron flow from anode rod 666 to vessel wall 624. For example, a voltage, current, and/or a voltage and current provided to anode rod 666 may cause a current it to flow from the higher potential of anode rod 666 to the lower ground potential of vessel wall 624. The flow of electrical current from anode rod 666 to vessel wall 624 may reduce or eliminate corrosion reactions occurring within water tank 664. Controller 671 may be configured to provide a voltage, current, and/or a voltage and current to anode rod 666 based on a size of water tank 664, a temperature setpoint for a water heating system comprising water tank 664, a total number of cycles undergone by a heating apparatus comprising the water heating system, or other criteria.

As illustrated at FIG. 6, water heater control system 600 may be configured such that both anode rod 666 and temperature sensor 668 access a body of water held by water tank 664 using spud 676. Providing for access of both temperature sensor 668 and anode rod 666 through a single access such as spud 676 may eliminate a need for two or more separate access into water tank 664 to accommodate both a temperature sensor and an anode rod. Additionally, the configuration of water heater control system 600 may allow reduction in the physical footprint of controller 671. With both temperature sensor 668 and anode rod 666 configured to access water tank 664 through spud 676, the relative proximity among temperature sensor 668, anode rod 666, and controller 671 may allow controller 671 to be mechanically supported and surrounded by (e.g., residing within) housing 672. As discussed, controller 671 may be configured to additionally direct operation of components controlling the heat production of water heating system 170, water heating system 270, water heating system 370. This compact arrangement may aid in replaceability and manufacturability. Additionally, because water heater control system 600 may only need to mate with a spud such as spud 676, the reduced physical footprint may allow the various components of water heater control system 600 to operate effectively with water heaters of varying volume and geometry.

Controller 671 may be configured to receive electrical power from power supply 682. Power supply 682 may be an AC or DC power supply. Power supply 682 may provide, for example, 220 VAC, 120 VAC, 100 VAC, and/or 24 VAC. Power supply 682 may be a line voltage from an electrical distribution system distributing electrical power throughout a structure. Power supply 682 may be electrical power generated by a thermoelectric device such as thermoelectric device 285. Power supply 682 may be an energy storage system configured to store energy generated by a thermoelectric device or provided through some other electrical source. The energy storage system may comprise a capacitor (e.g., a supercapacitor), a battery (e.g., a lithium battery), or some other energy storage device. The energy storage system may comprise an energy storage component which may be removed and replaced. The energy storage component may be rechargeable, such that the energy storage component is configured to have its stored electrical energy restored through a permanent or temporary connection to a power supply, for example thermoelectric device 285 or some other power supply. The energy storage component may be non-rechargeable.

Controller 671 may be configured to distribute electrical power received from power supply 682 to components which control the heat production of the water heater comprising water tank 664, such as relays, switches, servo valves, solenoids, or other devices. Controller 671 may be configured to establish and terminate electrical connectivity to the components using electronic devices. The electronic devices may comprise, for example, a field effect transistor (FET), a relay, a separate switching circuit, or any other device capable of establishing and terminating electrical contact in response to a signal from controller 671.

In examples, controller 671 may include any one or more of a microcontroller (MCU), e.g. a computer on a single integrated circuit containing a processor core, memory, and programmable input/output peripherals, a microcontroller (μP), e.g. a central processing unit (CPU) on a single integrated circuit (IC), a controller, a digital signal processor (DSP), an application specific integrated circuit (ASIC), a field-programmable gate array (FPGA), a system on chip (SoC) or equivalent discrete or integrated logic circuitry. A processor may be integrated circuitry, i.e., integrated processing circuitry, and that the integrated processing circuitry may be realized as fixed hardware processing circuitry, programmable processing circuitry and/or a combination of both fixed and programmable processing circuitry.

As illustrated, water heating components 670 may comprise water tank 664, vessel wall 624, inner vessel surface 623, outer vessel surface 630, outer shell 628, insulating layer 626, and spud 676. Water heater control system 600 may comprise mounting bracket 680, instrumentation 662 (comprising temperature sensor 668 and anode rod 666), electrical leads 632 (comprising anode lead 684 and sensor lead 686), housing 672, controller 671, mating surface 694, conduit space 690, gas valve 688, and power supply 682. These components may be configured to operate similarly to and in relation to other components of water heating components 670 and water heater control system 600 in the same manner as that discussed for the water tank, vessel wall, inner vessel surface, outer vessel surface, outer shell, insulating layer, spud, mounting bracket, instrumentation, electrical leads, housing, controller, mating surface, conduit space, gas valve, and power supply respectively of water heating systems 170, 270, 370, and water heating components 570 and water heater control system 500.

Figure 7:
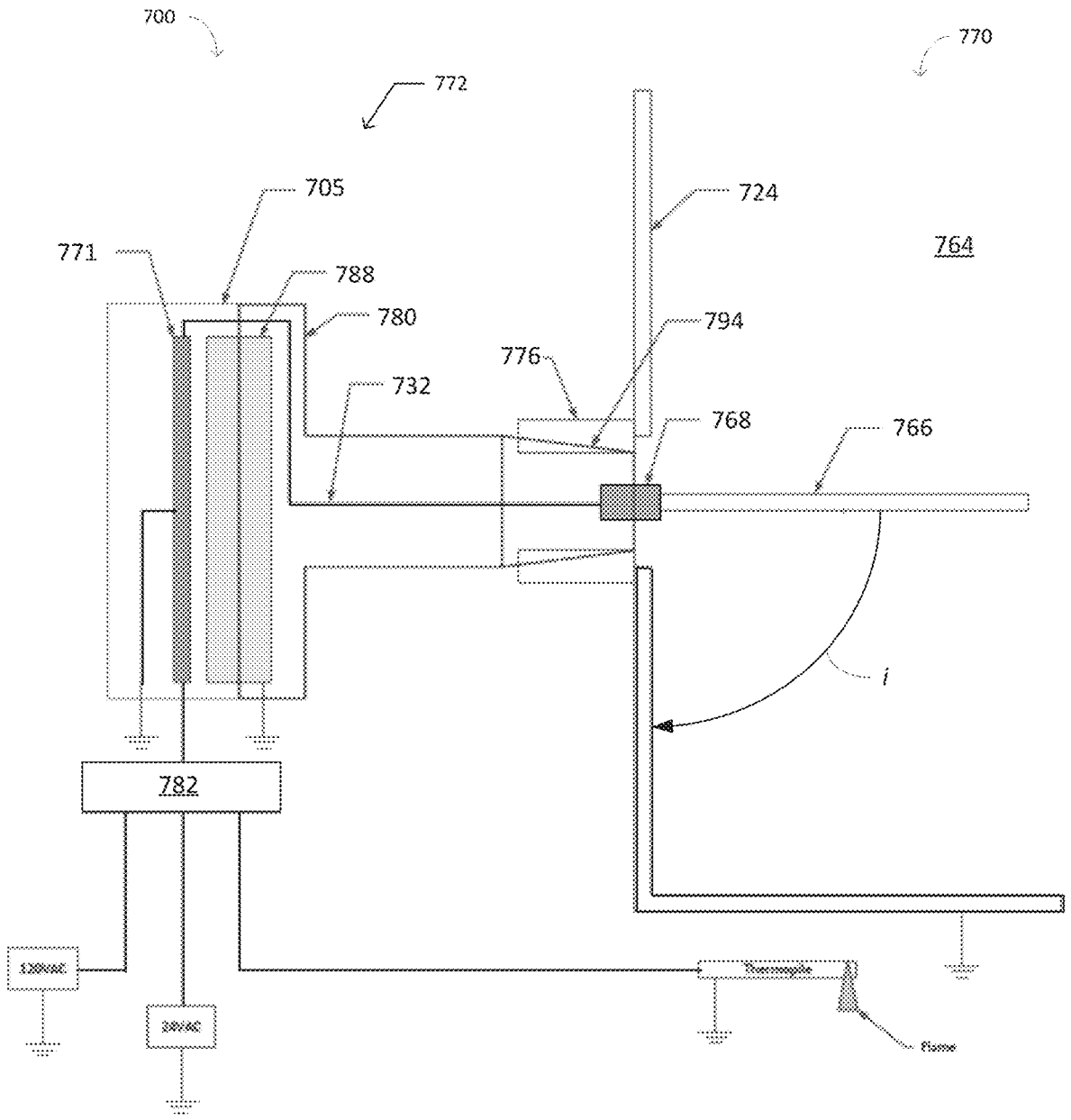
FIG. 7 is a diagram illustrating a controller of a water heating system and a power supply.

FIG. 7 is a diagram illustrating a water heater control system 700 and water heater components 770. Water heater control system 700 comprises controller 771, temperature sensor 768, and anode rod 766. Controller 771 may be a printed wire board (PWB). Mounting bracket 780 comprises mating surface 594 and may mate with and form a water-tight seal with spud 776. Mating surface 794 may comprise external threads meeting National Pipe Thread (NPT) standards. Mounting bracket 780 may mechanically support temperature sensor 768 and anode rod 766, and temperature sensor 768 and anode rod 766 may extend into an interior of water tank 764 when mounting bracket 780 mates with spud 776. Electrical leads 732 may comprise a sensor lead and an anode lead, and electrically connect controller 771 with temperature sensor 768 and anode rod 766. Electrical leads 732 may be, for example, a wiring harness, such as a 4-conductor wiring harness. A housing 772 comprises mounting bracket 780 and a cover 705. Cover 705 may be configured to provide control user interfaces. Housing 572 surrounds controller 771 and gas valve 788. Controller 771 may receive electrical power from power supply 782. Power supply 782 may receive, for example, 120 VAC power, 24 VAC power, and/or DC power from a thermopile configured to be in thermal communication with a flame, such as a pilot flame. Power supply 782 may receive electrical power from other sources. Controller 771 may be configured to distribute electrical power received from power supply 782 to components which control the heat production of a water heater, such as relays, switches, or other devices. Controller 771 may provide a voltage, a current, and/or a voltage and current to anode 766 and may cause polarization of vessel wall 724 of water tank 764 when water tank 764 holds a volume of water. Polarization of vessel wall 724 may be caused by electron flow from anode rod 766 to vessel wall 724, such as current i. The flow of electrical current from anode rod 766 to vessel wall 724 may reduce or eliminate corrosion reactions and flocculant formation within water tank 764.

Water tank 764, vessel wall 724, and spud 776, mounting bracket 780, electrical leads 732, temperature sensor 768, anode rod 766, housing 772, controller 771, mating surface 794, gas valve 788, and power supply 782 may be configured to operate similarly to and in relation to other components of water heating components 770 and water heater control system 700 in the same manner as that discussed for the water tank, vessel wall, spud, mounting bracket, electrical leads, temperature sensor, anode rod, housing, controller, mating surface, gas valve, and power supply respectively of water heating systems 170, 270, 370, and water heating components 570, 670 and water heater control system 500, 600.

Figure 8:
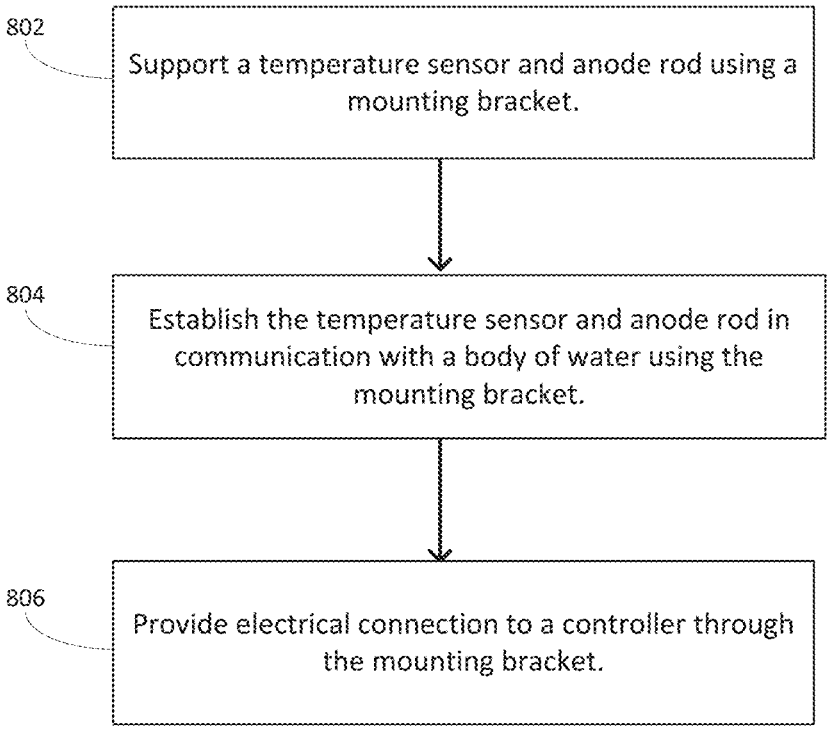
FIG. 8 is a flow diagram illustrating an example technique for controlling a water heater.

FIG. 8 is a flow diagram illustrating an example technique for controlling a water heater. For ease of description, the example technique of FIG. 8 is described with regard to system 670 although it is recognized that the technique may be employed by other systems including the other systems described herein. The technique may include mechanically supporting a temperature sensor 668 and an anode rod 666 using a mounting bracket 680 inserted into a spud 676 of the water tank 664 (802). The technique may include using the mounting bracket 680 to establish the temperature sensor 668 in thermal communication with a body of water within water tank 664 of the water heater. The technique may include using mounting bracket 680 to establish the anode rod 666 in fluid communication with the body of water within water tank 664 of the water heater (804). The technique may include providing electrical connectivity between the temperature sensor 668 and a controller 671 using a sensor lead 686 extending at least partially through mounting bracket 680. The technique may include providing electrical connectivity between the anode rod 666 and the controller 671 using an anode lead 684 extending at least partially through mounting bracket 680 (806). The technique may include receiving, using controller 671 and sensor lead 686, a signal indicative of a temperature of the body of water within water tank 664 from temperature sensor 668. The technique may include delivering, using controller 671 and the anode lead 684, a voltage, a current, or a voltage and current to anode rod 666.

The technique may further include generating a current from anode rod 666 to a vessel wall 624 of the water tank using the voltage, the current, or the voltage and the current delivered to anode rod 666. The technique may further include directing, using controller 671, one or more components of a heating apparatus to operate based on the signal indicative of the temperature of the body of water received by controller 671.

In one or more examples, functions described herein may be implemented in hardware, software, firmware, or any combination thereof. For example, the various components and functions of FIGS. 1-8 may be implemented in hardware, software, firmware, or any combination thereof. If implemented in software, the functions may be stored on a tangible computer-readable storage medium and executed by a processor or hardware-based processing unit.

Instructions may be executed by one or more processors, such as one or more DSPs, general purpose microcontrollers, ASICs, FPGAs, or other equivalent integrated or discrete logic circuitry. Accordingly, the term "processor," as used herein, such as may refer to any of the foregoing structure or any other structure suitable for implementation of the techniques described herein. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described.

Various examples have been described. These and other examples are within the scope of the following claims.

What is claimed is:

1. A water heating system comprising:

a tank defining an interior volume configured to hold water, the tank comprising a spud defining a specific opening through a vessel wall of the tank;

a heating apparatus configured to heat the water in the tank;

a temperature sensor extending into the interior volume of the tank, wherein the temperature sensor is configured to detect a temperature of water in the interior volume of the tank;

an anode configured to extend into the interior volume of the tank;

a controller configured to:

control, based on a detected temperature of the water in the tank, the heating apparatus to heat the water in the tank to a selected temperature; and control a power source to apply a voltage, a current, or a voltage and a current to the anode to at least one of reduce corrosion of a wall of the tank or reduce flocculant formation;

a sensor lead electrically connecting the controller and the temperature sensor, wherein the sensor lead is configured to extend at least partially through the spud; and an anode lead electrically connecting the controller and the anode, wherein the anode lead is configured to extend at least partially through the spud;

wherein the temperature sensor and the anode are integrally formed on a unitary probe;

wherein at least a portion of the anode extends from the temperature sensor;

wherein the anode extends further into the tank than the temperature sensor.

2. The water heating system of any one of claim 1, wherein the anode comprises at least one of titanium or stainless steel.

3. The water heating system of any one of claim 1, wherein the heating apparatus comprises at least one of a burner configured to burn a fuel to heat the water in the tank, an electrical heating element, or a heat pump.

4. The water heating system of claim 1, wherein the heating apparatus comprises an electrical heating element, and wherein the anode and the electrical heating element are integrally formed on a unitary component.

5. The water heating system of claim 1, wherein the wall of the tank defines an inner vessel surface in fluid communication with the interior volume of the tank, wherein the inner vessel surface comprises a metal without a ceramic or a polymeric coating.

6. The water heating system of claim 1, wherein the anode is configured to generate an electric current from the anode to the wall of the tank when the interior volume of the tank holds the water and the power source applies the voltage, the current, or the voltage and the current to the anode.

7. A method of controlling a water heater comprising:

mechanically supporting a temperature sensor and an anode using a mounting bracket inserted into a spud of the water heater, wherein the temperature sensor and the anode are integrally formed on a unitary probe, the unitary probe comprising a single rigid body supported by the mounting bracket; wherein at least a portion of the anode extends from the temperature sensor; wherein the anode extends further into the water heater than the temperature sensor;

placing the temperature sensor in thermal communication with a body of water within a water tank of the water heater using the mounting bracket inserted into the spud of the water heater;

placing the anode in fluid communication with the body of water within the water tank of the water heater using the mounting bracket inserted into the spud of the water heater;

electrically connecting the temperature sensor and a controller using a sensor lead extending at least partially through the mounting bracket;

electrically connecting the anode and the controller using an anode lead extending at least partially through the mounting bracket;

receiving, using the controller and the sensor lead, a signal indicative of a temperature of the body of water within the water tank from the temperature sensor; and delivering, using the controller and the anode lead, a voltage, a current, or a voltage and current to the anode.

8. The method of claim 7, further comprising generating a current from the anode to a vessel wall of the water tank using the voltage, the current, or the voltage and the current delivered to the anode.

9. A water heater control system comprising:

a temperature sensor;

an anode;

a controller configured to:

receive a signal indicative of a temperature from the temperature sensor; and apply a voltage, a current, or a voltage and a current to the anode;

a mounting bracket mechanically supporting the temperature sensor and the anode, wherein the mounting bracket is configured to mate with a spud of a water heater tank;

an anode lead electrically connecting the anode and the controller, wherein the anode lead extends at least partially through the mounting bracket; and a sensor lead electrically connecting the temperature sensor and the controller, wherein the sensor lead extends at least partially through the mounting bracket;

wherein the temperature sensor and the anode are integrally formed on a unitary probe, and wherein the unitary probe comprising a single rigid body supported by the mounting bracket.

10. The water heater control system of claim 9, wherein:

the temperature sensor is configured to extend into an interior volume defined by the water heater tank when the mounting bracket is configured to mate with the spud of the water heater tank, and the anode is configured to extend into the interior volume defined by the water heater tank when the mounting bracket is configured to mate with the spud of the water heater tank.

11. The water heater control system of claim 9, further comprising an electrical heating element, wherein the anode and the electrical heating element are integrally formed on a unitary component.

12. The water heater control system of claim 9 further comprising a housing configured to mechanically support the controller, wherein the mounting bracket is configured to mechanically support the housing.

13. The water heater control system of claim 9, wherein the mounting bracket is configured to form a water-tight seal with the spud of the water tank when the mounting bracket is configured to mate with the spud of the water heater tank.

14. The water heater control system of claim 9, further comprising a gas valve, wherein the controller is configured to control the gas valve based on the signal indicative of the temperature.

15. The water heater control system of claim 14, further comprising a housing configured to mechanically support the gas valve, wherein the mounting bracket is configured to mechanically support the housing.

16. The water heater control system of claim 9, wherein:

the anode is an anode rod comprising a first end and a second end, wherein the first end is electrically connected to the anode lead, and wherein the second end is configured to extend into an interior volume defined by the water heater tank when the mounting bracket is configured to mate with the spud of the water heater tank, and the mounting bracket is located between the controller and the second end of the anode rod.

17. The water heater control system of claim 9, wherein the mounting bracket comprises a mating surface surrounding a conduit space, wherein the mating surface is configured to engage the spud of the water heater tank when the mounting bracket is configured to mate with the spud of a water heater tank, and wherein an electrical connector and the anode lead extend at least partially into the conduit space.

18. The water heater control system of claim 9, further comprising:

a water heater including the spud and including the water heater tank, wherein an interior volume defined by the water heater tank is configured to hold a body of water; and a heating apparatus configured to heat the body of water when the interior volume holds the body of water, wherein:

the temperature sensor is configured to extend into the interior volume when the mounting bracket mates with the spud of the water heater tank, the anode is configured to extend into the interior volume when the mounting bracket mates with the spud of the water heater tank, the controller is configured to control, based on the signal indicative of the temperature from the temperature sensor, the heating apparatus to heat the body of water, and the controller is configured to provide the voltage, the current, or the voltage and the current to the anode to at least one of reduce corrosion of a wall of the tank or reduce flocculant formation.

* * * * *